US005902945A

United States Patent [19]

Nakano et al.

[11] Patent Number: 5,902,945

[45] Date of Patent: May 11, 1999

[54] PERCUSSION INSTRUMENT HAVING TONE BARS FOR GENERATING CLEAR TONES EXACTLY TUNED ALONG SCALE

[75] Inventors: Minoru Nakano, Aichi-Ken, Japan; Hiroaki Ohmuro, Shizuoka, Japan

[73] Assignee: Yamaha Corporation, Japan

[21] Appl. No.: 08/932,283

[22] Filed: Sep. 17, 1997

[30] Foreign Application Priority Data

Sep. 20, 1996 [JP] Japan ..... 8-249922

[51] Int. Cl.[6] ..... G10D 13/08

[52] U.S. Cl. ..... 84/402; 84/403; 84/102

[58] Field of Search ..... 84/102, 402, 403, 84/404, 410

[56] References Cited

U.S. PATENT DOCUMENTS 1,293,723 2/1919 Deagan .
1,632,751 6/1947 Winterhoff .
1,838,502 12/1931 Schulter .
2,655,069 10/1953 Marshall ..... 84/404
5,198,602 3/1993 Roper ..... 84/403
5,686,679 11/1997 Nakano et al. ..... 84/402

*Primary Examiner*—David S. Martin
*Assistant Examiner*—Marlon T. Fletcher
*Attorney, Agent, or Firm*—Ostrolenk, Faber, Gerb & Soffen, LLP

[57] ABSTRACT

A plurality of rectangular parallelopiped tone bars are incorporated in a percussion instrument, are connected to a supporting bar at central points thereof so as to produce the second-order vertical flexural vibration and the first-order torsional vibration, and the ratio of width to thickness is regulated to a frequency ratio of 1:2 so as to improve the interval between the percussion sounds and the consonance.

10 Claims, 8 Drawing Sheets

PERCUSSION INSTRUMENT HAVING TONE BARS FOR GENERATING CLEAR TONES EXACTLY TUNED ALONG SCALE

FIELD OF THE INVENTION

This invention relates to a percussion instrument and, more particularly, to tone bars incorporated in the percussion instrument for generating clear tones exactly tuned along a scale.

DESCRIPTION OF THE RELATED ART

A marimba, a vibraphone, glockenspiel and xylophone belong to the percussion instrument, and a plurality of tone bars are laid on a pattern like the keyboard of a standard piano. A player selectively strikes the tone bars with mallets to as to play a tune on the percussion instrument. The tone bars vibrate, and generate respective tones. The tone bars are held in contact with strings or small pieces of felt stretched over or provided on a frame. The contact points between each tone bar and the strings/felt pieces are matched with the nodes of the first-order vibrations generated in the tone bar.

A longitudinal vibration, transverse vibrations and a torsional vibration are mixed in the vibrations of the tone bar. One of the transverse vibrations proceeds in the direction of the thickness of the tone bar, and is hereinbelow referred to as "vertical flexural vibration". The other of the transverse vibrations proceeds in the direction of the width of the tone bar, and is hereinbelow referred to as "horizontal flexural vibration".

FIGS. 1A to 1D, FIGS. 2A and 2B and FIGS. 3A and 3B illustrate the vertical flexural vibration, the horizontal flexural vibration and the torsional vibration, respectively. In the following description, the surface to be struck with a mallet is called as "major surface", and the major surface without vibrations is referred to as "reference surface". A three-axis reference system is represented by x, y and z axes, and the reference surface is defined by x-axis and y-axis.

Each of these kinds of vibration contains a plurality of vibration orders. FIGS. 1A to 1D show the first-order to the fourth-order vibrations of the vertical flexural vibration. Although the vertical flexural vibration further contains higher-order vibrations over the fourth-order vibration, they are not shown. Reference numeral 1 designates a tone bar, and the first-order vibration, the second-order vibration, the third-order vibration and the fourth-order vibration are indicated by V0, V1, V2 and V3, respectively.

The vertical flexural vibration causes lateral lines 1*a* on the major surface to change the position on virtual planes defined by y-axis and z-axis. However, points on each lateral line are equal in distance from the reference surface. The first-order vibration V0 has two nodes at both ends of the tone bar 1, and the node is incremented by one together with the vibration order.

FIGS. 2A and 2B show the horizontal flexural vibration generated in the tone bar 1, and h0 and h1 indicate the first-order vibration and the second-order vibration, respectively. The horizontal flexural vibration causes the lateral lines la to change the position on a virtual plane parallel to the reference surface, but the lateral lines la are not changed in the virtual planes perpendicular to the reference surface. The first-order vibration h0 has two nodes on both ends of the tone bar 1, and the node is incremented together with the vibration order.

FIGS. 3A and 3*b* show the torsional vibration generated in the tone bar 1, and t0 and t1 indicate the first-order vibration and the second-order vibration, respectively. The torsional vibration causes a twisting motion to take place and the lateral lines la decline at different angles. The node is also incremented together with the vibration order.

The displacement of the horizontal flexural vibration and the displacement of the torsional vibration are much smaller than the displacement of the vertical flexural vibration, and, for this reason, the tone bars are designed and tuned in consideration of the vertical flexural vibration.

When the tone bars are designed for the glockenspiel, only the first-order vibration V0 is usually taken into account. The tone bars of the glockenspiel are identical in cross section with one another, and only the length is changed so as to change the frequency of the first-order vibration. However, the frequency ratio of the second-order vibration to the fourth-order vibration to the first-order vibration is 1:2.757:5.404:8.933, and is not represented by integers. This means that the glockenspiel generates percussion sounds which are not exactly tuned along the scale.

The frequency ratio between the first-order vibration and other high-order vibrations is regulable for the tone bars used in the vibraphone, the marimba or the xylophone. FIGS. 4A and 4B illustrate a tone bar 2 for those percussion instruments. A pair of string holes 2*a*/2*b* is formed in both end portions 2*c*/2*d* of the tone bar 2, and a central portion 2*e* is thinner than the end portions 2*c*/2*d*. In other words, a recess 2*f* is formed in the central portion 2*e*, and the recess 2*f* changes the frequencies of high-order vibrations. As a result, the frequency ratio of the second-order vibration to the first-order vibration is regulated to 1:4, or the frequency ratio of the second-order vibration and the third-order vibration to the first-order vibration is regulated to 1:4:10. FIGS. 5A and 5B show a tone bar 3. A pair of string holes 3*a*/3*b* is formed in the boundaries between the end portions 3*c*/3*d* and the central portion 3*e*, and two recesses 3*f*/3*g* are formed in the central portion 3*e*. The frequency ratio of the second-order vibration and the third-order vibration to the first-order vibration is regulated to 1:3:6 or 1:3:7 by virtue of the recesses 3*f*/3*g*. When the frequency ratio is represented by integers, the tone bars generate percussion sounds close to tones along the scale, and achieve clear intervals and good consonance. The good consonance results in a gentle beat produced through interference between a plurality of sounds with a small frequency difference.

Comparing the tone bar 2 with the tone bar 3, the tone bar 2 has the frequency ratio closer to $2^n$ than the tone bar 3, and, accordingly, achieves the consonance and the intervals better than those of the tone bar 3. However, the consonance and the intervals are worse than those of a string instrument or a wind instrument.

The recess 2*f* and the recesses 3*f*/3*g* are formed in the central portions 2*e* and 3*e*, and are open to the reverse surfaces of the central portions 2*e* and 3*e*. In order to make the frequency ratio closer to $2_n$, Japanese Patent Publication of Examined Application (Kokoku) No. 60-159894 proposes to laterally constrict a tone bar. In this instance, recesses are open to the side surfaces of the central portion. Japanese Patent Publication of Unexamined Application (Kokai) No. 8-202351 proposes to form recesses in not only the central portion but also end portions to as to make the frequency ratio between the first-order vibration, the second-order vibration and the third-order vibration much closer to $2^n$. The invention disclosed in the Japanese Patent Publication of Examined Application and the invention disclosed in the Japanese Patent Publication of Unexamined Application were assigned to Yamaha Corporation.

The recesses merely affect the vertical flexural vibrations of the tone bars, and can regulate the frequency ratio of the vertical flexural vibrations. However, the horizontal flexural vibration and the torsional vibration are not taken into account, and are not tuned. When the horizontal flexural vibration and the torsional vibration have respective frequencies different from but close to a high-order vibration of the vertical flexural vibration and each other, uncomfortable beat takes place, and deteriorate the consonance. Especially, the tone bar prolongs the torsional vibration rather than the transverse vibrations, and are noisy.

When the prior art tone bars form a percussion instrument played in an ensemble, the percussion sounds are liable to be buried in other sounds, and the audience hardly discriminates the percussion sounds from the other sounds.

SUMMARY OF THE INVENTION

It is therefore an important object of the present invention to provide a tone bar which generates a clear sound exactly tuned to a note of a scale and continued for long time.

To accomplish the object, the present invention proposes to regulate a frequency ratio of the second-order transverse vibration to the first-order torsional vibration to 1:2.

In accordance with one aspect of the present invention, there is provided a percussion instrument comprising a frame having at least one supporting bar, a plurality of tone bars each having a center point connected to the at least one supporting bar so as to allow a second-order transverse vibration and a first-order torsional vibration to take place therein, and a first regulating means for regulating a frequency ratio of the second-order transverse vibration to the first-order torsional vibration to 1:2.

BRIEF DESCRIPTION OF THE DRAWINGS

The features and advantages of the tone bar will be more clearly understood from the following description taken in conjunction with the accompanying drawings in which.

DESCRIPTION OF THE PREFERRED EMBODIMENTS

First Embodiment

Figure 6:
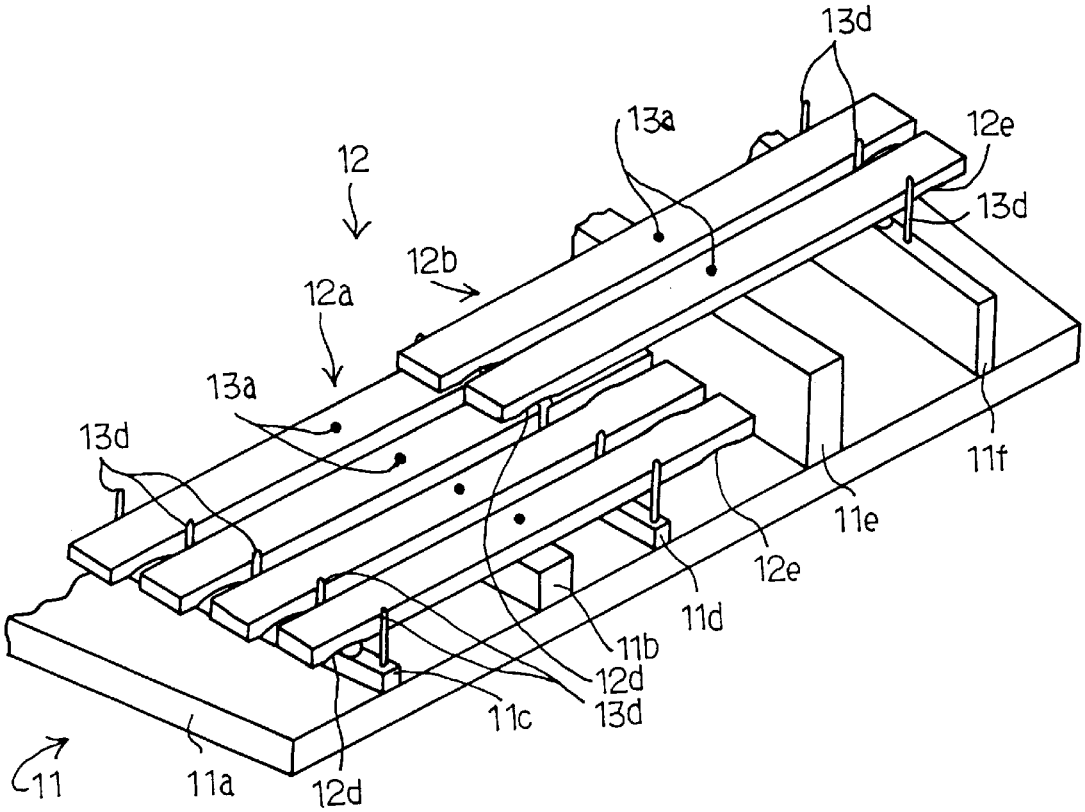
FIG. 6 is a perspective view showing the structure of a percussion instrument according to the present invention.

Referring to FIG. 6 of the drawings, a percussion instrument largely comprises a frame structure 11, a plurality of tone bars 12 supported by the frame structure 11, assembling parts 13 for assembling the tone bars 12 with the frame structure 11 and cushion members 14. The tone bars 12 are laid on the pattern of the keyboard of an acoustic piano, and a player selectively strikes the tone bars 12 with mallets (not shown). The tone bars 12 are arranged into two rows 12*a* and 12*b*, and the tone bars 12 in the first row respectively generate natural tones. On the other hand, the tone bars 12 in the second row respectively generate the semitones between the natural tones. The tone bars 12 have respective rectangular cross sections, and the length and the thickness are decreased from the tone bar 12 for the lowest pitch tone toward the highest pitch tone.

The frame structure 11 includes a supporting board 11*a* horizontally extending over a floor (not shown) and plurality of supporting bars 11*b*, 11*c*, 11*d*, 11*e* and 11*f* attached to the upper surface of the supporting board 11*a*. The supporting bars 11*b* to 11*f* are arranged in parallel to one another, and extend in the longitudinal direction of the supporting board 11*a*. The supporting bars 11*b* to 11*f* are spaced from one another in the lateral direction of the supporting board 11*a*, and are different in height. The supporting bars 11*b*, 11*c* and 11*d* are associated with the tone bars 12 for the natural tones, and the supporting bar 11*b* is higher than the other supporting bars 11*c* and 11*d*. On the other hand, the supporting bars 11*e* and 11*f* are associated with the tone bars 12 for the semitones, and are higher than the supporting bars 11*b* to 11*d*. For this reason, the tone bars 12 for the semitones are provided over the tone bars 12 for the natural tones.

Figure 7:
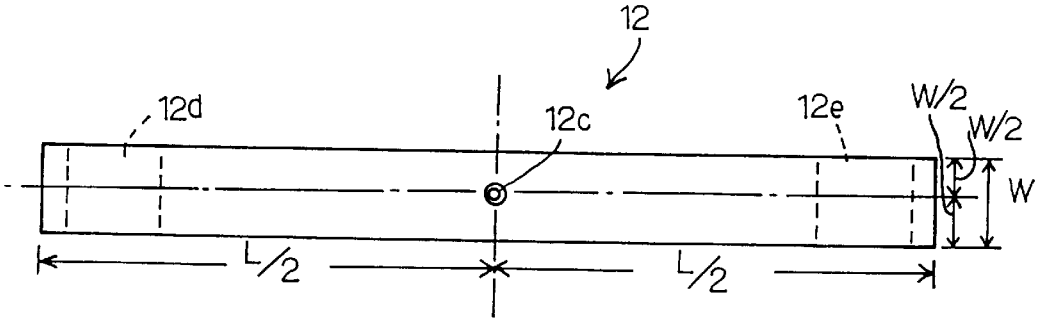
FIG. 7 is a plan view showing a tone bar incorporated in the percussion instrument.
Figure 8:
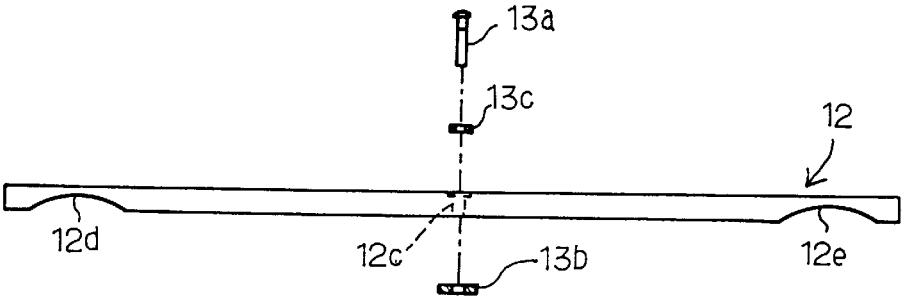
FIG. 8 is a front view showing the tone bar disassembled from a frame structure.
Figure 9:
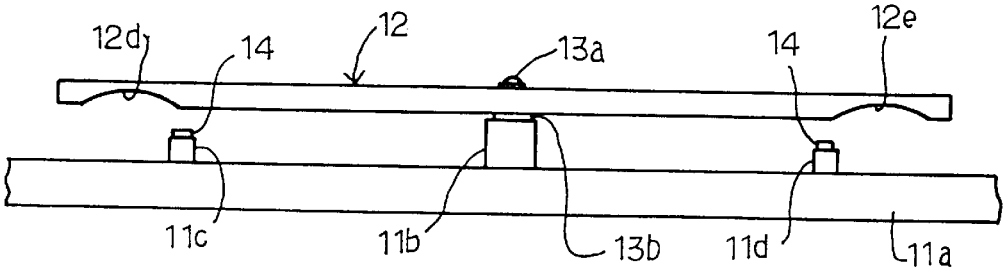
FIG. 9 is a front view showing the tone bar assembled with the frame structure.
Figure 10:
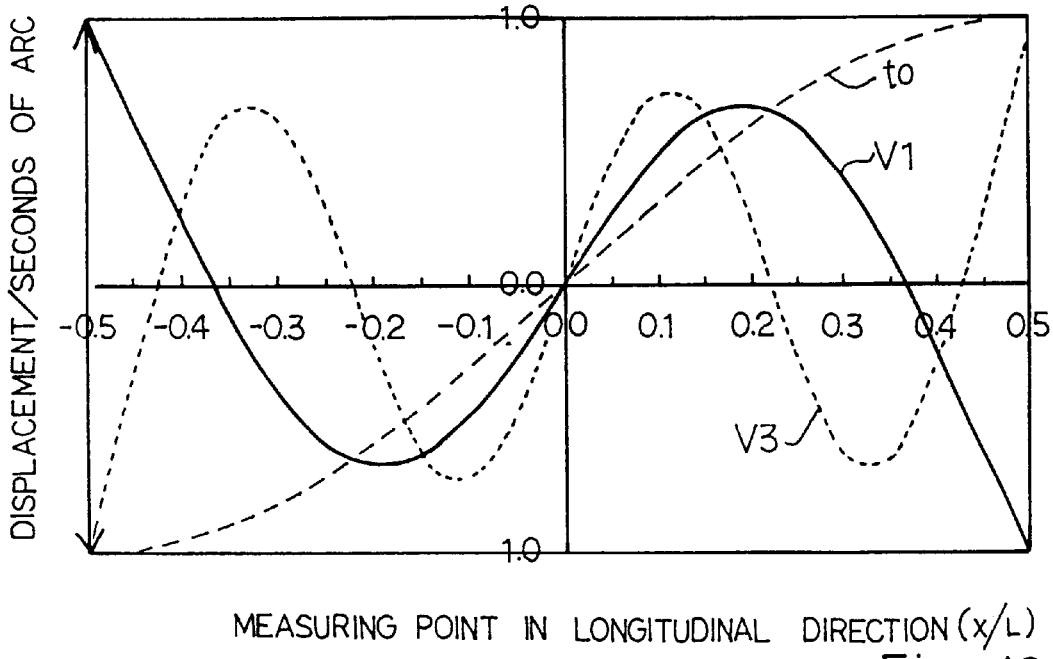
FIG. 10 is a graph showing the displacement of the second-order vertical flexural vibration, the displacement of the fourth-order vertical flexural vibration and the seconds of arc of the first-order torsional vibration in terms of a point changed in the longitudinal direction of a tone bar.

Description is focused on a tone bar 12 assembled with the supporting bar 11*b* with reference to FIGS. 7, 8 and 9. A through-hole 12*c* is formed at a center point of the tone bar 12. The center line in the direction of the width W meets the center line in the direction of the length L at the center point. The through-hole 12*c* is enlarged at the upper portion thereof (see FIG. 8). Recesses 12*d* and 12*e* are respectively formed in both end portions of the tone bar 12. However, a central portion of the tone bar is constant in thickness, and any recess is formed in the central portion.

A plurality of bolts 13*a*, a plurality of felt pads 13*b*, a plurality of felt washers 13*c* and spacer pins 13*d* are the assembling parts. The felt washer 13*c* is received into the enlarged portion of the through-hole 12*c*, and the felt pad 13*b* is inserted between the upper surface of the supporting bar 11*b*. The bolt 13*a* passes through the felt washer 13*c*, the through-hole 12*c* and the felt pad 13*b*, and is screwed into the supporting bar 11*b*. However, the bolt 13*a* does not strongly presses the tone bar 12 against the felt pad 13*b*, and the tone bar 12 is shakable with respect to the supporting bar 11*b*. For this reason, not only the vertical flexural vibration but also the torsional vibration take place in the tone bar 12.

The supporting bars 11*c*/11*d* are opposed to the boundaries between the central portion and the end portions of the tone bar 12, and the cushion members 14 are attached to the upper surfaces of the supporting bars 11*c*/11*d*. For this reason, even if the tone bar 12strongly shakes, the boundaries are brought into collision with the cushion members 14, and the tone bar 12 does not generate noise.

The pins 13*d* are implanted into the supporting bars 11*c* and 11*d* at intervals, and restrict a turning motion of the tone bar 12. For this reason, the tone bar 12 is never brought into contact with the adjacent tone bars 12.

The tone bars 12 for the semitones are loosely connected to the supporting bar 11*e* in a similar manner to the tone bars 12 for the natural tones, and are also shakable. The rear end portions of the tone bars 12 for the natural tones are overlapped with front end portions of the tone bars 12 for the semitones, and the pins 13*d* implanted into the supporting bar 11*f* restrict the turning motion of the tone bars 12 for the semitones. The pins 13*d* are preferably formed of soft material such as synthetic resin. The soft material prevents the pins 13*d* from noise at the collision with the tone bars 12.

Figure 1A:
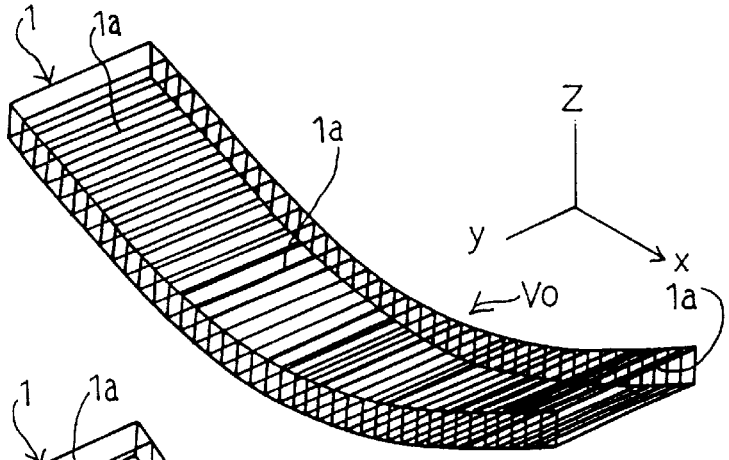
Fig. 1A PRIOR ART
FIGS. 1A to 1D are schematic views showing the vertical flexural vibration generated in the tone bar.
Figure 1B:
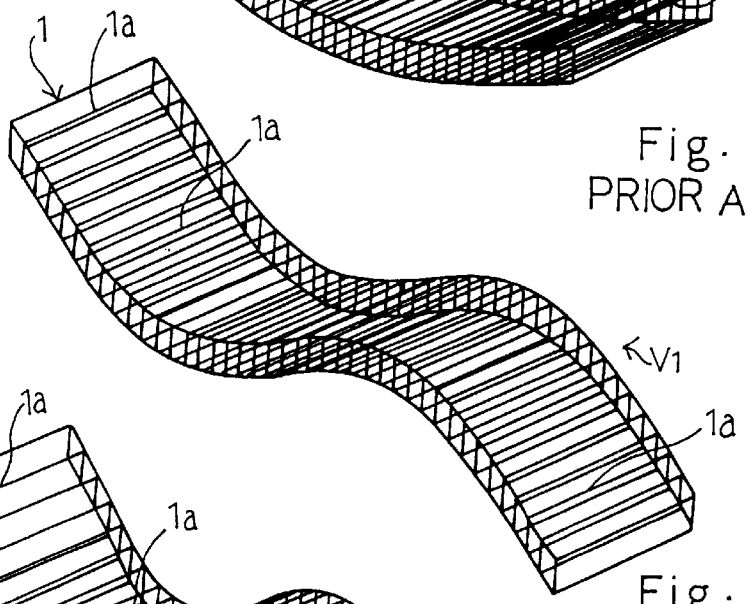
Fig. 1B PRIOR ART
Figure 1C:
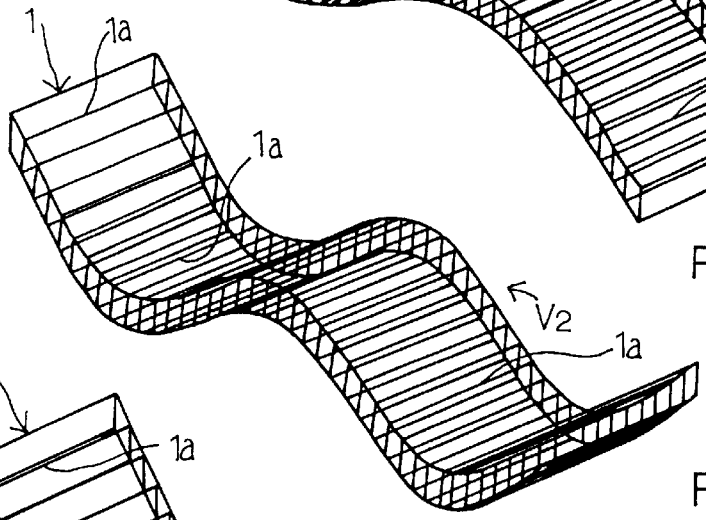
Fig. 1C PRIOR ART
Figure 1D:
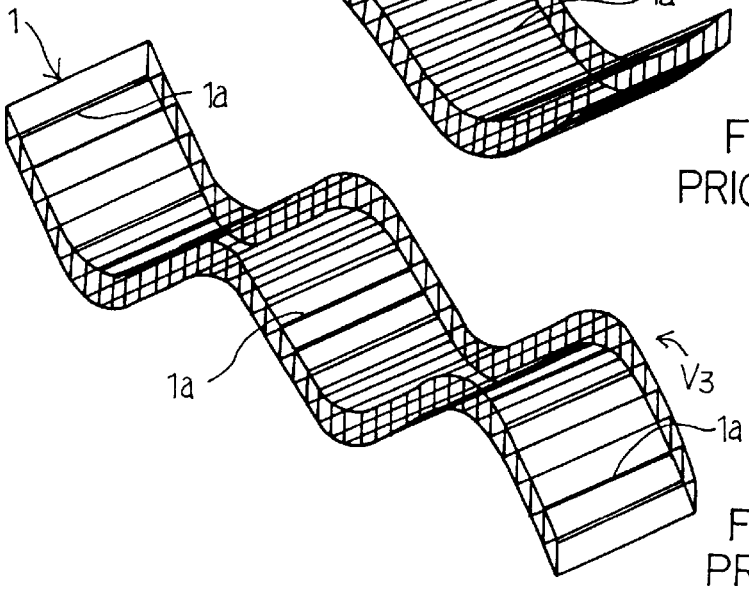
Fig. 1D PRIOR ART
Figure 2A:
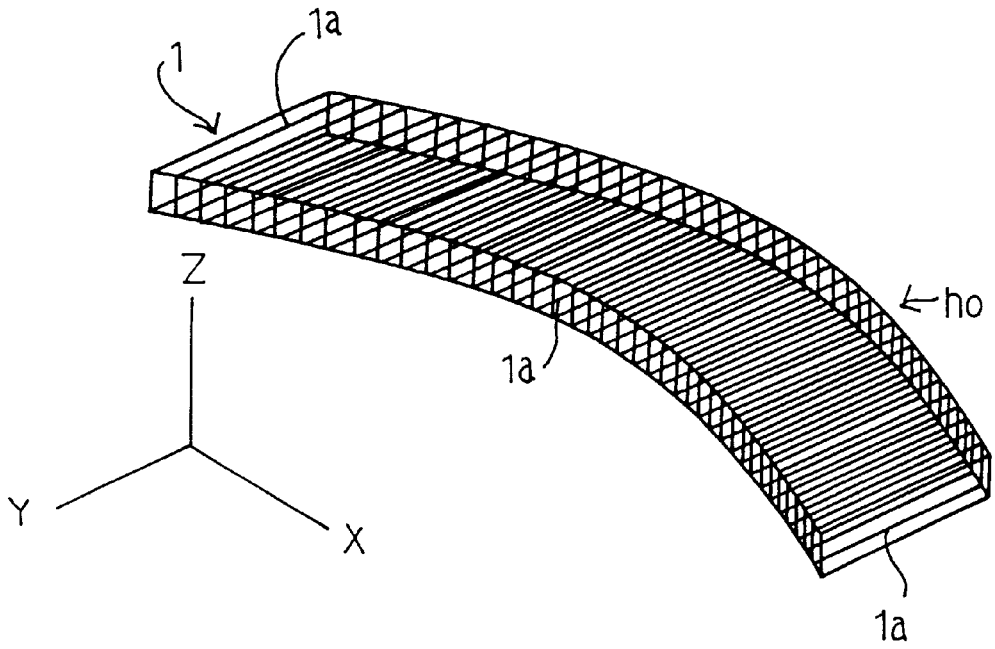
Fig. 2A PRIOR ART
FIGS. 2A and 2B are schematic views showing the horizontal flexural vibration generated in the turned bar.
Figure 2B:
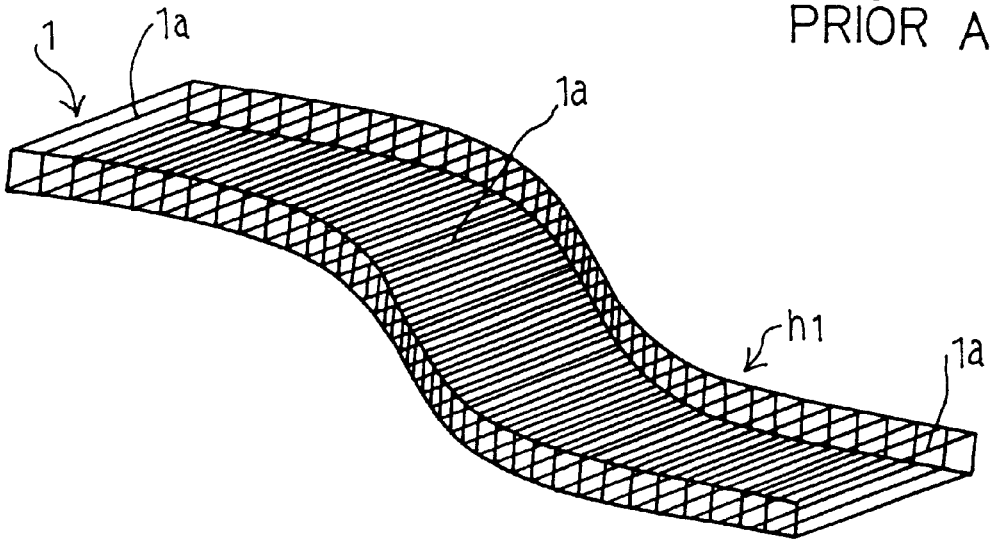
Fig. 2B PRIOR ART
Figure 3A:
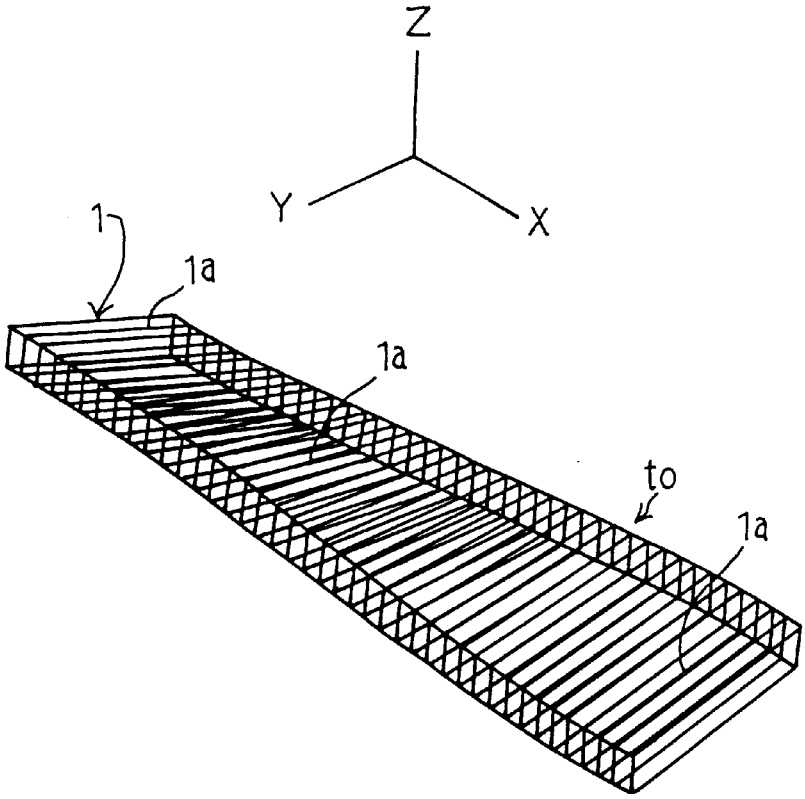
Fig. 3A PRIOR ART
FIGS. 3A and 3B are schematic views showing the torsional vibration generated in the turned bar.
Figure 3B:
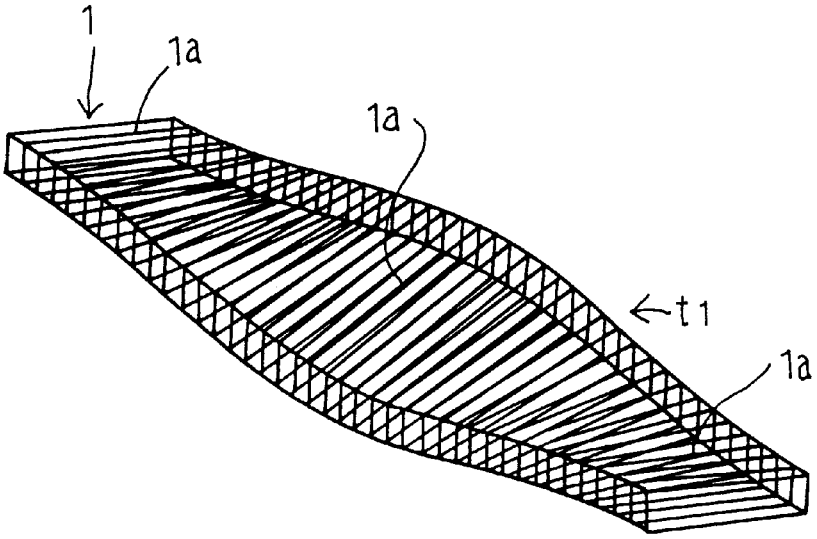
Fig. 3B PRIOR ART

The reason why the tone bar 12 is shakably supported at the center point thereof is that the center point is matched with a node of the second-order vibration of the vertical flexural vibration and a node of the first-order vibration of the torsional vibration. As shown in figure 1B, the second-order vibration has a nodal line coincidence with the center line at L/2, and FIG. 3A teaches us that the node of the first-order vibration is coincidence with the center point at L/2 and W/2. For this reason, the vertical flexural vibration has the even vibration orders, i.e., the second vibration order V1, the fourth vibration order, . . . , and the torsional vibration has the odd vibration orders, i.e., the first vibration order, the third vibration order, . . . However, the vibrations with the anti-nodes at the center point hardly take place in the tone bar 12 due to the restriction at the anti-nodes, and the vertical flexural vibration does not have the odd vibration orders, i.e., the first order vibration, the third order vibration . . . , and the torsional vibration does not have the even vibration orders such as the second order vibration. In this way, both of the vertical flexural vibration and the torsional vibration are controlled, and the ratio V1:t0 is regulated to 1:2 or a multiple thereof. The second-order vertical flexural vibration generates a fundamental tone of the tone bar 12.

The present inventors measured the vertical flexural vibration and the torsional vibration, and plotted the second-order vertical flexural vibration, the fourth-order vertical flexural vibration and the first-order torsional vibration as indicated by V1, V3 and to, respectively. The abscissa was indicative of x/L where x was the distance from the center point and L was the length of the tone bar. The displacement was measured for the second-order vertical flexural vibration and the fourth-order vertical flexural vibration, and the seconds of arc were measured for the first-order torsional vibration.

Figure 4A:
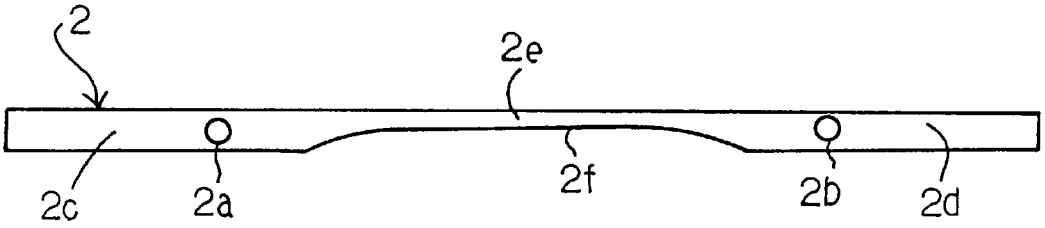
Fig. 4A PRIOR ART
FIG. 4A is a front view showing the prior art tone bar having the single recess.
Figure 4B:
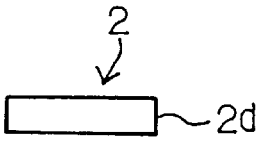
Fig. 4B PRIOR ART
FIG. 4B is a side view showing the prior art tone bar.
Figure 5A:
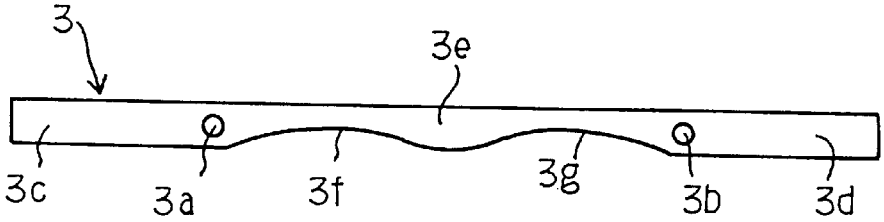
Fig. 5A PRIOR ART
FIG. 5A is a front view showing the prior art tone bar having the two recesses.
Figure 5B:
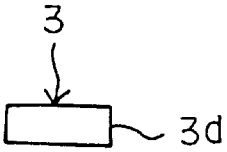
Fig. 5B PRIOR ART
FIG. 5B is a side view showing the prior art tone bar.

As will be understood from plots V1, V3 and t0, the restriction at the center point allows the tone bar to generate the second-order vertical flexural vibration, the fourth-order vertical flexural vibration and the first-order torsional vibration. The tone bar continues the torsional vibration longer than the vertical flexural vibration, and the percussion sound is prolonged. On the other hand, the prior art tone bars 2 and 3 shown in FIGS. 4A and 5A are restricted at the nodes of the first-order vertical flexural vibration by strings. For this reason, the second-order vertical flexural vibration is restricted in the tone bar 12.

Moreover, the restriction at the center point allows the tone bar to generate high-order vibrations. Although the high-order vibrations do not affect the interval between the tones generated by different tone bars, the high-order vibrations make the tone clear and sharp.

As described hereinbefore, the frequency ratio V1:t0 is regulated to 1:2 or a multiple thereof. The second-order vertical flexural vibration V1 gives the fundamental tone to the percussion sound, and the first-order torsional vibration t0 generates a harmonic tone one octave higher than the fundamental tone. For this reason, the uncomfortable beat does not take place, and the percussion sounds are consonant with one another. Another advantage of the second-order vertical flexural vibration serving as the fundamental tone is loudness larger than that of the first-order vertical flexural vibration serving as the fundamental tone, because the percussion sound is radiated from the area wider than that of the first-order vertical flexural vibration.

Subsequently, description is made on how to regulate the vertical flexural vibration and the torsional vibration. Assuming now that a tone bar has a rectangular cross section uniform in the longitudinal direction. The frequency Vn of the transverse vibration and the frequency Vtn of the torsional vibration are expressed by equations 1 and 2.

$$Vn = (m_n^2)/\left(2\sqrt{12\pi}\right)(h/L^2)\left(\sqrt{(E/\rho)}\right) \quad \text{Equation 1}$$

$$Vtn = \{(n+1)/L\}\gamma(b/h)\sqrt{(G/\rho)} \quad \text{Equation 2}$$

where L is length of the tone bar, b is width of the tone bar, h is thickness of the tone bar, E is Young's modulus, G is the modulus of shearing elasticity, ρ is density, $m_n$ is a constant determined by the vibration order n and γ is a constant determined by b/h. As will be understood from equation 1, the frequency Vn of the transverse direction is proportional to the thickness h. However, the width b does not affect the frequency Vn. On the other hand, the frequency Vtn is dependent on γ. γ is a constant determined by the ratio between the width b and the thickness h. When b/h is 1, γ has the maximum value. On the other hand, when the ratio is spaced from 1, γ is decreased. The square cross section, i.e., the ratio b/h=1 maximizes the frequency Vtn, and the frequency Vtn is decreased together with the thickness.

For this reason, a tone bar is regulable to the frequency ratio V1:t0=1:2 by changing the configuration of the tone bar. In detail, the length L and the thickness h are determined so as to have the second-order vertical flexural vibration regulated to a target pitch. Subsequently, the width b is changed so as to have the frequency ratio of V1:t0=1:2. For this reason, the tone bars 12 are gradually decreased in width from the lowest pitch tone toward the highest pitch tone.

The tone bar 12 has the recesses 12*d*/12*e* in both end portions, and the recesses 12*d*/12*e* are outside the nodes of the second-order vertical flexural vibration V1. The recesses 12*d*/12*e* regulates the frequency ratio of V1:t0:V3 to 1:2:3. In detail, if there is no recess, the frequency ratio of V0:V1:V2:V3 of the tone bar is 1.000:2.757:5.404:8.933. Although the restriction at the center point eliminates the first-order vertical flexural vibration V0 and the third-order vertical flexural vibration V2 from the tone bar, the fourth-order vertical flexural vibration V3 remains together with the second order vertical flexural vibration V1, and the vertical flexural vibration has the frequency ratio of V1:t0:V3=1:2:3.240. The frequency ratio is not desirable for the consonance. However, when the recesses 12*d*/12*e* are formed outside the nodes of the nodes of the second-order vertical flexural vibration for partially decreasing the thickness, the recesses selectively decrease the frequency of the fourth-order vertical flexural vibration V3.

The frequency regulation is described hereinbelow. Bending moment and the torsional moment affects the vertical flexural vibration and the torsional vibration, respectively. If a portion where the bending moment/torsional moment is large is partially cut off, the tone bar decreases the frequency of the vertical flexural vibration/torsional vibration. On the other hand, if a portion outside the outermost node of the flexural vibration/torsional vibration is partially cut off, the tone bar increases the frequency of the vertical flexural vibration/torsional vibration. Thus, the frequency of the vibration is controllable by partially removing the tone bar.

Figure 11:
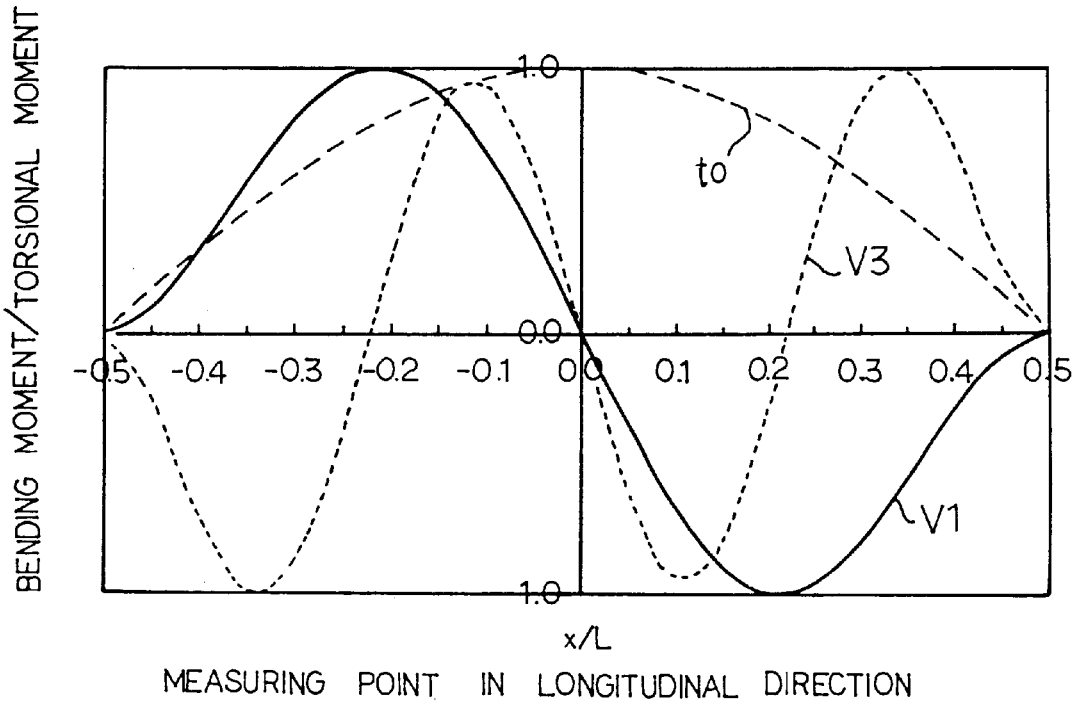
FIG. 11 is a graph showing bending moment and torsional moment exerted on a tone bar.

FIG. 11 illustrates the bending moment for the second-order vertical flexural vibration V1, the bending moment for the fourth-order vertical flexural vibration and the torsional moment for the first-order torsional vibration. The torsional moment is maximized at the center point, i.e., x/L=0. However, the bending moment for the second-order vertical flexural vibration and the bending moment for the fourth-order vertical flexural vibration are minimized at the center point. If the tone bar is partially cut away at the center point, the tone bar selectively decreases the frequency of the first-order torsional vibration without any influence on the frequency of the second-order vertical flexural vibration and the frequency of the fourth-order vertical flexural vibration.

In order to selectively decreases the frequency of the second-order vertical flexural vibration, the tone bar is partially cut away at x/L=0.2 where the bending moment for the second-order vertical flexural vibration is maximized. Similarly, if the tone bar is partially cut away at x/L=0.4 to 0.5, the decrement of the frequency of the fourth-order vertical flexural vibration is much larger than those of the second-order vertical flexural vibration and the first-order torsional vibration. In this way, the frequency ratio V1:t0:V3 is regulated to 1:2:3 in the tone bar 12. The tone bars with the frequency ratio of 1:2:3 make the interval between the percussion sounds clearer than tone bars with the frequency ratio of V1:t0=1:2, and enhance the consonance.

Second Embodiment

Figure 12:
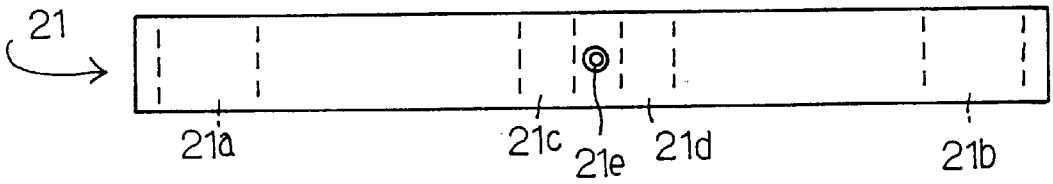
FIG. 12 is a plan view showing a tone bar incorporated in another percussion instrument according to the present invention.
Figure 13:
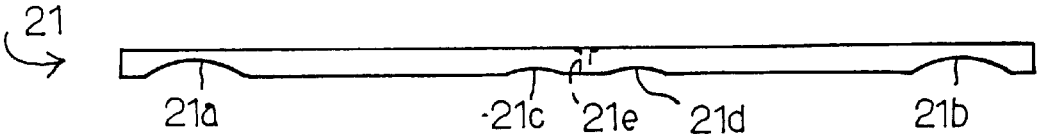
FIG. 13 is a front view showing the tone bar shown in FIG. 12.

FIGS. 12 and 13 illustrate a tone bar 21 incorporated in another percussion instrument embodying the present invention. The percussion instrument implementing the second embodiment is similar to the first embodiment except for the configuration of the tone bar 21, and, for this reason, description is focused on the configuration of the tone bar 21.

The tone bar 21 has a pair of recesses 21*a*/21*b* corresponding to the recesses 12*d*/12*e* and a pair of recesses 21*c*/21*d* formed in the central area on both sides of a through hole 21*e*. The pair of recesses 21*c*/21*d* aims at decreasing the frequency of fourth-order vertical flexural vibration V3, and the two pairs of recesses 21*a*/21*b* and 21 c/21*d* exactly regulate the frequency ratio of V1:t0:V3 to 1:2:3.

Third Embodiment

Figure 14:
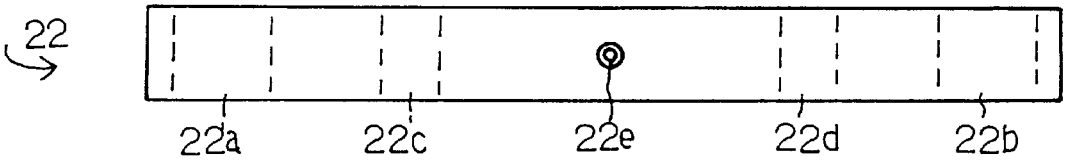
FIG. 14 is a plan view showing a tone bar incorporated in yet another percussion instrument according to the present invention.
Figure 15:
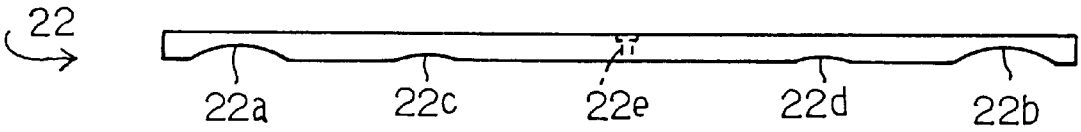
FIG. 15 is a front view showing the tone bar shown in FIG. 14.

FIGS. 14 and 15 illustrate a tone bar 22 incorporated in yet another percussion instrument embodying the present invention. The percussion instrument implementing the third embodiment is similar to the first embodiment except for the configuration of the tone bar 22, and, for this reason, description is focused on the configuration of the tone bar 22.

The tone bar 22 has a pair of recesses 22*a*/22*b* corresponding to the recesses 12*d*/12*e* and a pair of recesses 22*c*/22*d* formed spaced from a through hole 22*e* rather than the pair of recesses 21*c*/21*d*. The pair of recesses 22*c*/22*d* aims at decreasing the frequency of second-order vertical flexural vibration V1, and the two pairs of recesses 22*a*/22*b* and 22*c*/22*d* exactly regulate the frequency ratio of V1:t0:V3 to 1:2:3.

Fourth Embodiment

Figure 16:
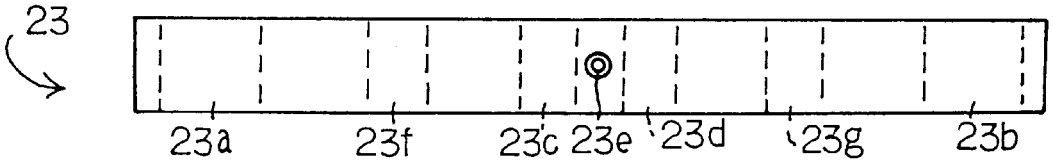
FIG. 16 is a plan view showing a tone bar incorporated in still another percussion instrument according to the present invention.
Figure 17:
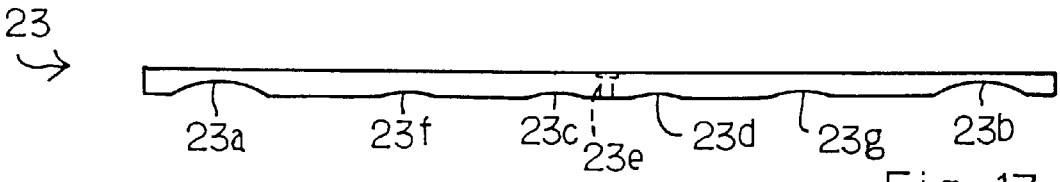
FIG. 17 is a front view showing the tone bar shown in FIG. 16.

FIGS. 16 and 17 illustrate a tone bar 23 incorporated in still another percussion instrument embodying the present invention. The percussion instrument implementing the fourth embodiment is similar to the first embodiment except for the configuration of the tone bar 23, and, for this reason, description is focused on the configuration of the tone bar 23.

The tone bar 23 has a pair of recesses 23*a*/23*b* corresponding to the recesses 12*d*/12*e*, a pair of recesses 23*c*/23*d* corresponding to the recesses 21*c*/21*d* on both sides of a through-hole 23*e* and a pair of recesses 23*f*/23*g* corresponding to the recesses 22*c*/22*d*. The pair of recesses 23*c*/23*d* and the pair of recesses 23*f*/23*g* aims at decreasing the frequency of the fourth-order vertical flexural vibration V3 and the frequency of the second-order vertical flexural vibration V1, and the three pairs of recesses 23*a*/23*b*, 23*c*/23*d* and 23*f*/23*g* exactly regulate the frequency ratio of V1:t0:V3 to 1:2:3.

As will be appreciated from the foregoing description, the second-order vertical flexural vibration V1 and the first-order torsional vibration t0 are regulated to the frequency ratio V1:t0=1:2, and the tone bars are improved in interval, the consonance and loudness.

When the fourth-order vertical flexural vibration V3 is further taken into account, the second-order vertical flexural vibration V1, the first-order torsional vibration t0 and the fourth-order vertical flexural vibration V3 are regulated to the frequency ratio V1:t0:V3=1:2:3, and the tone bars are further improved in the interval and the consonance.

Although particular embodiments of the present invention have been shown and described, it will be obvious to those skilled in the art that various changes and modifications may be made without departing from the spirit and scope of the present invention.

For example, the edge between the reverse surface and the curved surface defining the recess may be rounded.

The tone bars may be arranged in a single row.

What is claimed is:

1. A percussion instrument comprising a frame having at least one supporting bar, a plurality of tone bars each having a center point connected to said at least one supporting bar so as to allow a second-order transverse vibration and a first-order torsional vibration to take place therein, and a first regulating means for regulating a frequency ratio of said second-order transverse vibration to said first-order torsional vibration to 1:2.

2. The percussion instrument as set forth in claim 1, in which said plurality of tone bars are shaped into a generally rectangular parallelopiped configuration, and a center line in a longitudinal direction meets a center line in a transverse direction at said center point.

3. The percussion instrument as set forth in claim 2, in which said first regulating means is implemented by a ratio of a width of each tone bar to a thickness of said each tone bar.

4. The percussion instrument as set forth in claim 1, further comprising a second regulating means for regulating said second-order transverse vibration, said first-order torsional vibration and a fourth-order transverse vibration to a frequency ratio of 1:2:3.

5. The percussion instrument as set forth in claim 4, in which said plurality of tone bars are shaped into a generally rectangular parallelopiped configuration, and a center line in a longitudinal direction meets a center line in a transverse direction at said center point.

6. The percussion instrument as set forth in claim 5, in which said first regulating means is implemented by a ratio of a width of each tone bar to a thickness of said each tone bar, and said second regulating means is implemented by a deformed portion of each tone bar thinner than another portion of said each tone bar.

7. The percussion instrument as set forth in claim 6, in which said deformed portion has an upper surface coplanar with an upper portion of said another portion and a deformed lower surface closer to said upper surface than a lower portion of said another portion.

8. The percussion instrument as set forth in claim 7, in which a bending moment for said second-order transverse vibration is maximized at said deformed portion.

9. The percussion instrument as set forth in claim 7, in which a bending moment for said fourth-order transverse vibration is maximized at said deformed portion.

10. The percussion instrument as set forth in claim 8, in which said each tone bar further has another deformed portion where a bending moment for said fourth-order transverse vibration is maximized at said another deformed portion.

* * * * *